US009865382B2

(12) United States Patent
Tabata et al.

(10) Patent No.: US 9,865,382 B2
(45) **Date of Patent: *Jan. 9, 2018**

(54) ALLOY FLAKES AS STARTING MATERIAL FOR RARE EARTH SINTERED MAGNET AND METHOD FOR PRODUCING SAME

(75) Inventors: Shinya Tabata, Kobe (JP); Kazumasa Shintani, Kobe (JP); Takuya Onimura, Kobe (JP)

(73) Assignee: SANTOKU CORPORATION, Kobe-shi, Hyogo (JP)

( * ) Notice: Subject to any disclaimer, the term of this patent is extended or adjusted under 35 U.S.C. 154(b) by 260 days.

This patent is subject to a terminal disclaimer.

(21) Appl. No.: 14/236,195

(22) PCT Filed: Jul. 30, 2012

(86) PCT No.: PCT/JP2012/069301

§ 371 (c)(1),
(2), (4) Date: Jan. 30, 2014

(87) PCT Pub. No.: WO2013/018751

PCT Pub. Date: Feb. 7, 2013

(65) Prior Publication Data

US 2014/0134040 A1 May 15, 2014

(30) Foreign Application Priority Data

Aug. 3, 2011 (JP) ..... 2011-180954

(51) Int. Cl.
*H01F 1/20* (2006.01)
*B22D 11/00* (2006.01)
(Continued)

(52) U.S. Cl.
CPC ..... *H01F 1/20* (2013.01); *B22D 11/0651* (2013.01); *C22C 38/002* (2013.01);
(Continued)

(58) Field of Classification Search
CPC ..... H01F 1/0571; H01F 1/0577; H01F 1/20; C22C 38/00; C22C 38/005; B22D 11/00; B22D 11/06; B22D 11/0651; B22D 1/055
See application file for complete search history.

(56) References Cited

U.S. PATENT DOCUMENTS 7,004,228 B2 2/2006 Murakami et al.
7,390,369 B2 * 6/2008 Odaka ..... B22F 1/0003 148/101

(Continued)

FOREIGN PATENT DOCUMENTS

CN 1440317 A 9/2003
CN 1942264 A 4/2007

(Continued)

OTHER PUBLICATIONS

International Searching Authority, International Preliminary Report on Patentability dated Feb. 4, 2014 issued in corresponding International application No. PCT/JP2012/069301.

(Continued)

*Primary Examiner* — Keith Walker
*Assistant Examiner* — John Hevey
(74) *Attorney, Agent, or Firm* — Sughrue Mion, PLLC

(57) ABSTRACT

Provided are raw material alloy flakes for a rare earth sintered magnet and a method for producing the same. The alloy flakes have a roll-cooled face, and (1) contain at least one R selected from rare earth metal elements including Y, B, and the balance M including iron, at a particular ratio; (2) as observed in a micrograph at a magnification of 100× of its roll-cooled face, have not less than 5 crystals each of which is a dendrite grown radially from a point of crystal nucleation, and crosses a line segment corresponding to 880 μm; and (3) as observed in a micrograph at a magnification of 200× of its section taken generally perpendicularly to its (Continued)

roll-cooled face, have an average distance between R-rich phases of not less than 1 μm and less than 10 μm.

8 Claims, 2 Drawing Sheets

(51) Int. Cl.

| | |
|---|---|
| ***C22C 38/10*** | (2006.01) |
| ***C22C 38/16*** | (2006.01) |
| ***H01F 1/057*** | (2006.01) |
| ***B22D 11/06*** | (2006.01) |
| ***C22C 38/00*** | (2006.01) |
| ***C22C 38/06*** | (2006.01) |

(52) U.S. Cl.
CPC ..... *C22C 38/005* (2013.01); *C22C 38/06* (2013.01); *C22C 38/10* (2013.01); *C22C 38/16* (2013.01); *H01F 1/0571* (2013.01); *H01F 1/0577* (2013.01); *C22C 2202/02* (2013.01)

(56) References Cited

U.S. PATENT DOCUMENTS

| | | | | |
|---|---|---|---|---|
| 7,547,365 | B2 | 6/2009 | Murakami et al. | |
| 8,105,446 | B2 * | 1/2012 | Shintani ..... | B22F 1/0055 148/101 |
| 2005/0028892 | A1 | 2/2005 | Sasaki | |
| 2005/0098239 | A1 | 5/2005 | Kuniyoshi et al. | |
| 2010/0200121 | A1 * | 8/2010 | Shintani ..... | B22F 1/0055 148/302 |
| 2011/0012699 | A1 | 1/2011 | Odaka et al. | |
| 2013/0142687 | A1 | 6/2013 | Onimura et al. | |

FOREIGN PATENT DOCUMENTS

| | | | |
|---|---|---|---|
| CN | 103079724 | A | 5/2013 |
| JP | 08-150442 | A | 6/1996 |
| JP | 08-264363 | A | 10/1996 |
| JP | 2002-059245 | A | 2/2002 |
| JP | 2004043921 | A | 2/2004 |
| JP | 2004-181531 | A | 7/2004 |
| WO | 2012/002531 | A1 | 1/2012 |

OTHER PUBLICATIONS

International Searching Authority, International Search Report of PCT/JP2012/069301 dated Aug. 21, 2012.

European Patent Office, Communication dated Oct. 8, 2015 in counterpart application No. 12820207.4.

State Intellectual Property Office of People's Republic of China; Communication dated Apr. 25, 2017 issued in counterpart application No. 201280048482.7.

* cited by examiner

ALLOY FLAKES AS STARTING MATERIAL FOR RARE EARTH SINTERED MAGNET AND METHOD FOR PRODUCING SAME

CROSS REFERENCE TO RELATED APPLICATIONS

This is a National Stage of International Application No. PCT/JP2012/069301 filed Jul. 30, 2012, claiming priority based on Japanese Patent Application No. 2011-180954 filed Aug. 3, 2011, the contents of all of which are incorporated herein by reference in their entirety.

FIELD OF ART

The present invention relates to raw material alloy flakes for rare earth sintered magnets and a method for producing the same.

BACKGROUND ART

Magnets for various motors used in vehicles, wind power generation, and the like are demanded to have still greater magnetic properties in order to meet social needs for downsizing and weight saving of electronic devices, and for energy and resource saving to cope with global warming, which has been becoming obvious. Among various measures taken, development of $R_2Fe_{14}B$-based rare earth sintered magnets having a high magnetic flux density have actively been made.

A $R_2Fe_{14}B$-based rare earth sintered magnet is generally prepared by melting and casting a raw material, pulverizing the resulting raw material alloy for rare earth sintered magnet into magnet alloy powder, molding the powder in a magnetic field, sintering and ageing the molded product. Pulverization of the raw material alloy for rare earth sintered magnets is performed generally by the combination of hydrogen decrepitation effected by subjecting the raw material alloy to hydrogen absorption/desorption and jet milling effected by bombardment of the raw material alloy in a jet stream. The raw material alloy for rare earth sintered magnet contains a $R_2Fe_{14}B$-based compound phase as a main phase (sometimes referred to as the 2-14-1-based main phase), an R-rich phase containing more rare earth metal elements than the 2-14-1-based main phase (sometimes referred to simply as the R-rich phase hereinbelow), and a B-rich phase containing more boron than the 2-14-1-based main phase (sometimes referred to simply as the B-rich phase hereinbelow). It is known that the alloy structure composed of the 2-14-1-based main phase, R-rich phase, and B-rich phase of the raw material alloy for rare earth sintered magnets affects the pulverizability of the raw material alloy and the characteristics of a resulting rare earth sintered magnet.

Patent Publication 1 discloses a rapidly cooling roll for use in production of rare earth alloys. This publication discloses that, by controlling the Sm and Ra values of the cooling roll surface, the rare earth alloy ribbons produced by using the cooling roll are given uniform short axis diameters both in the center and the ends of the ribbons.

Patent Publication 2 discloses a method of producing rare earth-containing alloy ribbons. This publication discloses that chill crystals and regions with extremely finely dispersed R-rich phases may be reduced by the use of a cooling roll which is provided on its surface with generally linear irregularities extending at an angle of not less than 30° with respect to the rotational direction of the roll to have a particular Rz value.

Patent Publication 1: JP-2002-59245-A
Patent Publication 2: JP-2004-181531-A

SUMMARY OF THE INVENTION

It is an object of the present invention to provide raw material alloy flakes for rare earth sintered magnets which have undergone suppressed generation of chill crystals, and have quite uniform 2-14-1-based main phase shapes and R-rich phase dispersion.

It is another object of the present invention to provide a method for producing raw material alloy flakes for rare earth sintered magnets which realizes industrial production of the above-mentioned alloy flakes.

In strip casting with a cooling roll, the surface conditions of the cooling roll have conventionally been controlled to make uniform the alloy structure of the resulting flakes. However, no research has been made concerning the effect of the crystals observed on the roll-cooled face given on the alloy structure, which crystals are dendrites grown radially from a point of crystal nucleation. The present inventors have confirmed close relationship between the number of the crystals observed on the roll-cooled face and the alloy structure of a section taken generally perpendicularly to the flake face which was in contact with the cooling roll surface, which crystals are dendrites grown radially from a point of crystal nucleation, have an aspect ratio of 0.5 to 1.0 and a grain size of not smaller than 30 μm, to thereby complete the present invention.

According to the present invention, there are provided raw material alloy flakes for a rare earth sintered magnet having a roll-cooled face, obtained by strip casting with a cooling roll, and satisfying requirements (1) to (3) below (sometimes referred to as the alloy flakes of the present invention hereinbelow):

(1) said alloy flakes comprise 27.0 to 33.0 mass % of at least one R selected from the group consisting of rare earth metal elements including yttrium, 0.90 to 1.30 mass % of boron, and the balance M including iron;

(2) said alloy flakes, as observed in a micrograph at a magnification of 100× of its roll-cooled face, have not less than 5 crystals each of which is a dendrite grown radially from a point of crystal nucleation, has an aspect ratio of 0.5 to 1.0 and a grain size of not smaller than 30 μm, and crosses a line segment corresponding to 880 μm; and (3) said alloy flakes, as observed in a micrograph at a magnification of 200× of its section taken generally perpendicularly to its roll-cooled face, have an average distance between R-rich phases of not less than 1 μm and less than 10 μm.

According to the present invention, there is also provided a method for producing raw material alloy flakes for a rare earth sintered magnet comprising the steps of:

providing a raw material alloy melt consisting of 27.0 to 33.0 mass % of at least one R selected from the group consisting of rare earth metal elements including yttrium, 0.90 to 1.30 mass % of boron, and the balance M including iron; and cooling and solidifying said raw material alloy melt on a cooling roll having a surface roughness Ra of 2 to 15 μm and a surface roughness Rsk of not less than −0.5 and less than 0.

According to the present invention, there is further provided a method for producing a rare earth sintered magnet comprising the steps of:

providing alloy flakes having a roll-cooled face, obtained by strip casting with a cooling roll, and satisfying requirements (1) to (3) above;

pulverizing said alloy flakes into alloy powder;

molding in a magnetic field, sintering, and ageing said alloy powder.

In the alloy flakes according to the present invention, generation of chill crystals has been suppressed, and the 2-14-1-based main phase shapes and the R-rich phase dispersion are quite uniform, so that rare earth sintered magnets having excellent magnetic properties may be produced from these alloy flakes. Further, the production method according to the present invention, which employs the step of cooling and solidifying the alloy melt of the particular composition mentioned above on a cooling roll having a particular surface structure, allows easy production of the present alloy flakes in an industrial scale.

PREFERRED EMBODIMENTS OF THE INVENTION

Figure 1:
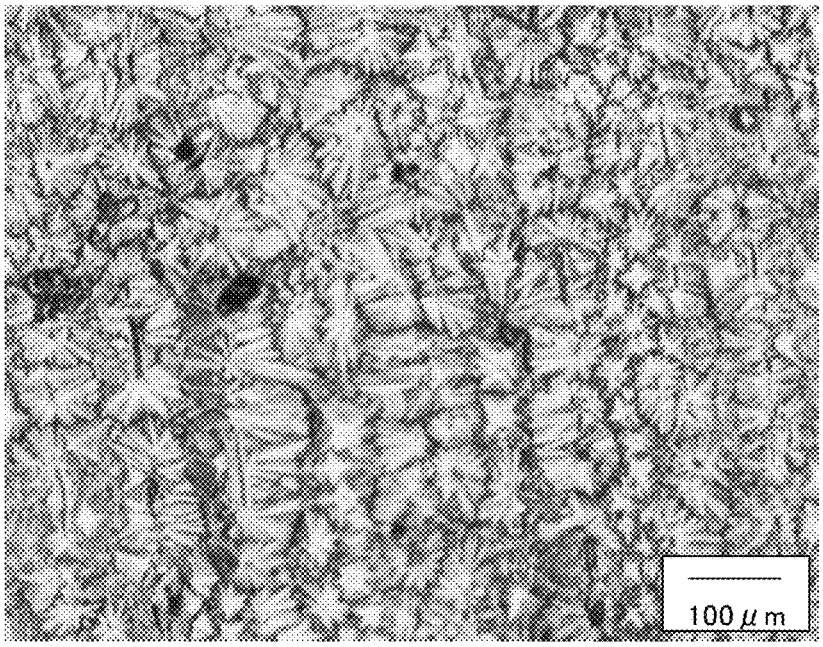
FIG. 1 is a copy of a micrograph of an alloy flake obtained in Example 1 taken on its roll-cooled face.

The present invention will now be explained in detail.

The alloy flakes of the present invention satisfy requirement (1) of comprising 27.0 to 33.0 mass % of at least one R selected from the group consisting of rare earth metal elements including yttrium, 0.90 to 1.30 mass % of boron, and the balance M including iron. Here, the amount of the balance M is the balance aside from R and boron, and the present alloy flakes may optionally contain inevitable impurities other than these elements.

The rare earth metal elements including yttrium mean lanthanoids with atomic numbers 57 to 71 and yttrium with atomic number 39. R is not particularly limited, and may preferably be lanthanum, cerium, praseodymium, neodymium, yttrium, gadolinium, terbium, dysprosium, holmium, erbium, ytterbium, or a mixture of two or more of these. It is particularly preferred that R contains praseodymium or neodymium as the main component, and also at least one heavy rare earth element selected from the group consisting of gadolinium, terbium, dysprosium, holmium, erbium, and ytterbium.

These heavy rare earth elements mainly improve coercivity among various magnetic properties. Above all, terbium has the most significant effect. However, terbium is expensive and thus, in view of the cost-benefit performance, it is preferred to employ dysprosium alone or in combination with gadolinium, terbium, holmium, or the like.

The content of R is 27.0 to 33.0 mass %. At less than 27.0 mass %, the amount of the liquid phase required for densification of a sintered body of rare earth sintered magnet is not sufficient, and thus the density of the sintered body is low, resulting in inferior magnetic properties. On the other hand, at over 33.0 mass %, the ratio of the R-rich phase in the sintered body is high, which lowers corrosion resistance. In addition, the volume ratio of the 2-14-1-based main phase is consequently low, which causes low remanent magnetization.

When the alloy flakes of the present invention are to be used in a single-alloy method, the content of R is preferably 29.0 to 33.0 mass %, whereas when the present alloy flakes are to be used as a 2-14-1-based main phase alloy in a two-alloys method, the content is preferably 27.0 to 29.0 mass %.

The content of boron is 0.90 to 1.30 mass %. At less than 0.90 mass %, the ratio of the 2-14-1-based main phase is low, resulting in low remanent magnetization, whereas at over 1.30 mass %, the ratio of the B-rich phase is high, resulting in both low magnetic properties and corrosion resistance.

The balance M contains iron as an essential element. The content of iron in the balance M is usually not less than 50 mass %, preferably 60 to 72 mass %, most preferably 64 to 70 mass %. The balance M may optionally contain at least one element selected from the group consisting of transition metals other than iron, silicon, and carbon, and may also contain impurities inevitable in industrial scale production, such as oxygen and nitrogen.

The transition metals other than iron are not particularly limited, and may preferably be at least one element selected from the group consisting of cobalt, aluminum, chromium, titanium, vanadium, zirconium, hafnium, manganese, copper, tin, tungsten, niobium, and gallium.

Though the alloy flakes of the present invention allow for the presence of inevitable impurities, the contents of alkali metal elements, alkaline earth metal elements, and zinc (sometimes referred to collectively as volatile elements hereinbelow) therein are preferably not more than 0.10 mass % in total. The total amount of the volatile elements is more preferably not more than 0.05 mass %, most preferably not more than 0.01 mass %. At over 0.10 mass %, chill crystals are generated, and it may be hard to obtain an alloy having extremely uniform shapes of the 2-14-1-based main phase and R-rich phase dispersion. The reason for this may be explained as follows.

$R_2Fe_{14}B$-based raw material alloys for rare earth sintered magnets have a melting point of over 1200° C. and accordingly, heating and melting of the raw materials are performed at as high a temperature as 1200° C. or higher. In this case, however, since alkali metal elements, alkaline earth metal elements, and zinc evaporate at lower temperatures, these volatile elements, when contained at over 0.10 mass % of the alloy, cause a large amount of evaporation. Part of the evaporated elements precipitates on the cooling roll surface, or reacts with a minute amount of oxygen or the like in the furnace. When the cooling roll having the volatile elements precipitated on its surface is used in rapid cooling and solidification of the raw material melt, the volatile elements on the roll surface react with the base material of the roll to form a film mainly composed of the volatile elements on the roll surface. It is conceivable that this film obstructs heat conduction between the melt and the cooling roll to cause insufficient control of growth of the generated crystal nuclei. Insufficiently grown nuclei will be released from the roll surface due to convection of the melt or the like, and become chill crystals.

The alloy flakes of the present invention are alloy flakes having a roll-cooled face and obtained by strip casting with a cooling roll, and particularly preferably alloy flakes having a roll-cooled face on one side and obtained by strip casting with a single roll. When a single roll is employed, the face of the flakes opposite from the roll-cooled face is solidified without contacting with the cooling roll, and is termed a free face. Here, the roll-cooled face means the face formed by the contact of the raw material alloy melt with the cooling roll surface to cool and solidify during production.

The thickness of the alloy flakes of the present invention is usually about 0.1 to 1.0 mm, preferably about 0.2 to 0.6 mm.

The alloy flakes of the present invention satisfy requirement (2) of having not less than 5 crystals each of which is a dendrite grown radially from a point of crystal nucleation, has an aspect ratio of 0.5 to 1.0 and a grain size of not smaller than 30 μm, and crosses a line segment corresponding to 880 μm, as observed on a micrograph at a magnification of 100× of the roll-cooled face. More preferably, the number of the crystals is not less than 8 and not more than 15. The number of the crystals obtained industrially is usually not more than 30. When the number of the crystals is not less than 5, growth of the generated crystal nuclei has not been obstructed and has been under control. This causes a sectional structure to have little chill crystals generated, and quite uniform shapes of the 2-14-1-based main phase and the R-rich phase dispersion. As discussed above, when the contents of the volatile elements are controlled concurrently, the number of the crystals within this range, in combination with the suppression of negative impact of the volatile elements, results in alloy flakes of a quite uniform structure, and a magnet produced with such alloy flakes will have remarkable magnetic properties.

The number of the crystals is counted in the following manner. In a micrograph at a magnification of 100×, the boundary of a crystal which is a dendrite grown radially from a point of crystal nucleation, forms a closed curve. This is taken as one crystal, and the average of the short axis diameter and the long axis diameter of the closed curve is taken as the grain size. The value of "the short axis diameter/the long axis diameter" is taken as the aspect ratio. Three line segments each corresponding to 880 μm are drawn to evenly divide the micrograph into four, and the number of the crystals is counted, each of which crystals is a dendrite grown radially from a point of crystal nucleation, has an aspect ratio of 0.5 to 1.0 and a grain size of not smaller than 30 μm, and crossing a line segment corresponding to 880 μm. The average for the three lines is taken as the number of the crystals.

The alloy flakes of the present invention satisfy requirement (3) of having an average distance between the R-rich phases of not less than 1 μm and less than 10 μm as observed in a micrograph at a magnification of 200× of a section taken generally perpendicularly to the roll-cooled face. More preferably, the average distance between the R-rich phases is not less than 3 μm and not more than 6 μm.

The average distance of not less than 1 μm and less than 10 μm between the R-rich phases in the alloy flakes is preferred because, when the alloy flakes are subjected to hydrogen decrepitation or jet milling in a pulverization step in magnet production, the resulting alloy powder is less likely to contain a plurality of crystal grains of different crystal orientations.

The alloy flakes of the present invention preferably have a small variation in the distance between the R-rich phases. With a small variation, the alloy powder obtained by pulverization may be given a uniform particle size of a desired distribution. An index of variation in the distance between the R-rich phases, which is obtained by dividing the standard deviation of the distance between the R-rich phases by the average distance between the R-rich phases, is preferably not more than 0.20, more preferably not more than 0.18. With the use of such uniform alloy powder, abnormally large crystal grain growth is not observed in a sintering step of magnet production, so that the coercivity of the magnet is improved.

The average distance between the R-rich phases may be determined by the following manner.

First, a micrograph of a sectional structure of an alloy flake of the present invention generally perpendicular to the roll-cooled face (parallel to the direction of thickness of the flake) is taken at a magnification of 200× under an optical microscope. The R-rich phases are present as boundary phases of the 2-14-1-based main phase dendrites. The R-rich phases are usually present in a linear fashion, but may be in some cases present in an insular fashion, depending on the thermal history of the casting process. Even when the R-rich phases are in the form of islands, if arranged in series in an apparent line, the islands of the R-rich phases are connected and regarded as linear R-rich phases.

Three line segments each corresponding to 440 μm are drawn on a sectional face generally perpendicular to the face of an alloy flake of the present invention which was in contact with the cooling roll surface, to evenly divide the sectional face into four. The number of the R-rich phases crossing each line segment is counted, and the length of the line segment, 440 μm, is divided by the obtained number. Ten of the alloy flakes are subjected to the same measurement to obtain 30 measured values, and the average of the 30 values is taken as the average distance between the R-rich phases. Further, the standard deviation is also calculated from the 30 measured values.

The alloy flakes of the present invention are preferably free of α-Fe phases, but may contain the same as long as the pulverizability of the flakes is not greatly impaired. α-Fe phases usually appear where the cooling rate of the alloy is low. For example, in the production of alloy flakes by a single-roll strip casting, the α-Fe phases appear on the free face. The α-Fe phases, if contained, are preferably precipitated in a grain size of not larger than 3 μm in a volume percentage of less than 5%.

The alloy flakes of the present invention hardly contain fine equiaxed crystal grains, i.e., chill crystals, but may contain the same as long as the magnetic properties are not greatly impaired. Chill crystals principally appear where the cooling rate of the alloy flakes is high. For example, in the production of alloy flakes by single-roll strip casting, the chill crystals appear near the roll-cooled face. The chill crystals, if contained, are preferably in a volume percentage of less than 5%.

The alloy flakes of the present invention may be obtained in an industrial scale by, for example, the following production method according to the present invention.

The production method according to the present invention comprises the steps of: providing a raw material alloy melt consisting of 27.0 to 33.0 mass % of at least one R selected from the group consisting of rare earth metal elements including yttrium, 0.90 to 1.30 mass % of boron, and the balance M including iron; and cooling and solidifying the raw material alloy melt on a cooling roll having a surface roughness Ra of 2 to 15 μm and a surface roughness Rsk of not less than −0.5 and less than 0.

The balance M of the raw material alloy melt may optionally contain the balance M other than iron mentioned above.

According to the production method of the present invention, unalloyed R, boron, and M, or alloys containing these are blended as the raw materials, depending on the composition of the desired alloy. Then, the blended raw materials are heated to melt in vacuum or inert gas atmosphere, and the resulting raw material alloy melt is cooled and solidified by strip casting with a single roll or twin rolls. The cooling roll is preferably a single roll.

In the method of the present invention, the total content of the alkali metal elements, alkaline earth metal elements, and zinc in the raw materials is preferably not more than 0.15 mass % in total. More preferably the total content of the volatile elements is not more than 0.10 mass %, most preferably not more than 0.05 mass %. With the total content of the volatile elements of not more than 0.15 mass %, the total content of the volatile elements in the resulting alloy flakes may easily be controlled to not more than 0.10 mass %. Preferably, by a vacuuming process in heating and melting, the volatile elements are discharged out of the system before precipitated on the cooling roll. The volatile elements are incorporated principally from the raw materials containing R. It is assumed that the contamination is originated from the separation and purification of R. By selecting the raw materials, the content of the volatile elements, which have been taken as inevitable impurities and thus have not been taken into consideration, may be controlled.

In the method of the present invention, as mentioned above, the cooling roll has a surface roughness Ra of 2 to 15 μm and a surface roughness Rsk of not less than −0.5 and less than 0, more preferably not less than −0.4 and less than 0. With a cooling roll having a surface roughness Rsk of not less than −0.5 and less than 0, release of the generated crystal nuclei from the roll surface may be suppressed, in other words, precipitation of chill crystals may be suppressed. The cooling roll preferably has a surface roughness Ra of 2 to 8 μm. By controlling the Ra value, the number of crystal nucleation may be controlled. With the use of a cooling roll having a surface roughness Ra of 2 to 15 μm and a surface roughness Rsk of not less than −0.5 and less than 0, requirement (2) of the alloy flakes of the present invention may be controlled.

The surface texture of the cooling roll may be controlled, for example, by abrasion, laser processing, transcription, thermal spraying, or shotblasting. The abrasion may be performed with sandpaper in a particular direction, and then with sandpaper with a coarser grit size in a direction at 80 to 90° with respect to that particular direction. If the abrasion is performed without changing the grit size of the sandpaper, the Rsk value may be less than −0.5, and precipitation of the chill crystals may not be suppressed. Further, the surface irregularities of the cooling roll tend to be linear, and accordingly dendrites are less likely to grow radially, and the number of the crystals mentioned above may not be controlled to be not less than 5.

The thermal spraying may be performed with the shape of the thermal spray material and the spraying conditions being controlled. Specifically, an atypical thermal spray material having a high melting point may partly be mixed to the thermal spray material. The shotblasting may be performed with the shape of the blasting material and the conditions of blasting being controlled. Specifically, blasting materials of various particle sizes or atypical blasting materials may be used.

According to the method of the present invention, the alloy flakes obtained from cooling and solidifying on the cooling roll may be, after released from the cooling roll, pulverized, heated, held at a particular temperature, and cooled as desired according to known processes.

EXAMPLES

The present invention will now be explained in more detail with reference to Examples, which do not limit the present invention.

Example 1

Raw materials were blended taking the yield into consideration so as to eventually obtain alloy flakes of 23.5 mass % Nd, 6.7 mass % Dy, 0.95 mass % B, 0.15 mass % Al, 1.0 mass % Co, 0.2 mass % Cu, and the balance iron, and melted using an alumina crucible in a high frequency induction furnace in an argon gas atmosphere to obtain a raw material alloy melt. The obtained alloy melt was strip-casted in a casting device having a single water-cooled copper roll, into alloy flakes of about 0.3 mm thickness.

The cooling roll used had been abraded on the surface in the direction of rotation of the roll with #120 sandpaper and at 90° with respect to the direction of rotation with #60 sandpaper, so that the cooling roll had a surface roughness Ra of 3.01 μm and a surface roughness Rsk of −0.44. The raw materials were selected so that the content of the volatile elements in the raw materials was not more than 0.05 mass %, and the content of the volatile materials in the obtained alloy flakes was not more than 0.01 mass %.

Figure 2:
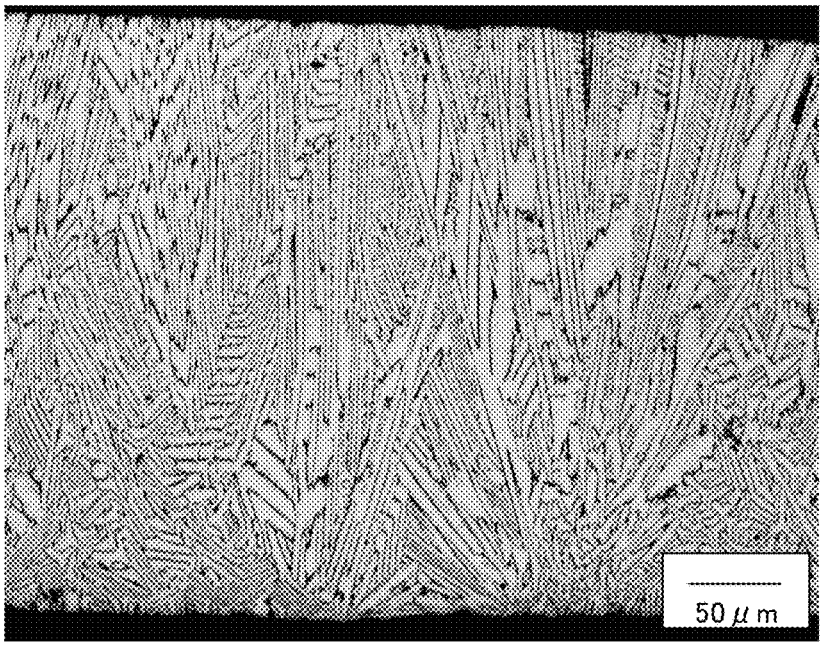
FIG. 2 is a copy of a micrograph of a sectional structure of the alloy flake obtained in Example 1.

The obtained alloy flakes were observed on the roll-cooled face in the manner discussed above, to find that the number of the crystals was 15, each of which crystals was a dendrite grown radially from the point of nucleation, had an aspect ratio of 0.5 to 1.0 and a grain size of not smaller than 30 μm, and crossed the line segment corresponding to 880 μm. Observation of the sectional structure of the alloy flakes revealed no chill crystals. The average distance between the R-rich phases was 4.51 μm, and the value obtained by dividing the standard deviation of the distance between the R-rich phases by the average distance between the R-rich phases was 0.15. A copy of the micrograph of the roll-cooled face of an obtained alloy flake is shown in FIG. 1, and a copy of the micrograph of the sectional structure taken generally perpendicular to the roll-cooled face is shown in FIG. 2.

Using the obtained alloy flakes as a raw material, a sintered magnet was produced. The obtained sintered magnet had a remanent magnetization (Br) of 12.65 kG, and a coercivity (iHc) of 26.49 kOe. The results are shown in Table 1.

Example 2

Alloy flakes and a sintered magnet were prepared in the same way as in Example 1 except that a cooling roll was used which had been abraded in the direction of rotation of the roll with #60 sandpaper and at 90° with respect to the direction of rotation with #30 sandpaper, and had Ra and Rsk values shown in Table 1. The various measurements were made in the same way as in Example 1. The results are shown in Table 1.

Example 3

Alloy flakes and a sintered magnet were prepared in the same way as in Example 1 except that a cooling roll was used which had been shotblasted instead of the abrasion with sandpapers, and had Ra and Rsk values shown in Table 1.

The various measurements were made in the same way as in Example 1. The results are shown in Table 1.

Example 4

Alloy flakes and a sintered magnet were prepared in the same way as in Example 1 except that the raw materials were selected so as to have a volatile element content of 0.90 mass %, and a cooling roll having Ra and Rsk values shown in Table 1 was used. The content of the volatile elements in the obtained alloy flakes was 0.11 mass %. The various measurements were made in the same way as in Example 1. The results are shown in Table 1.

Comparative Example 1

Figure 3:
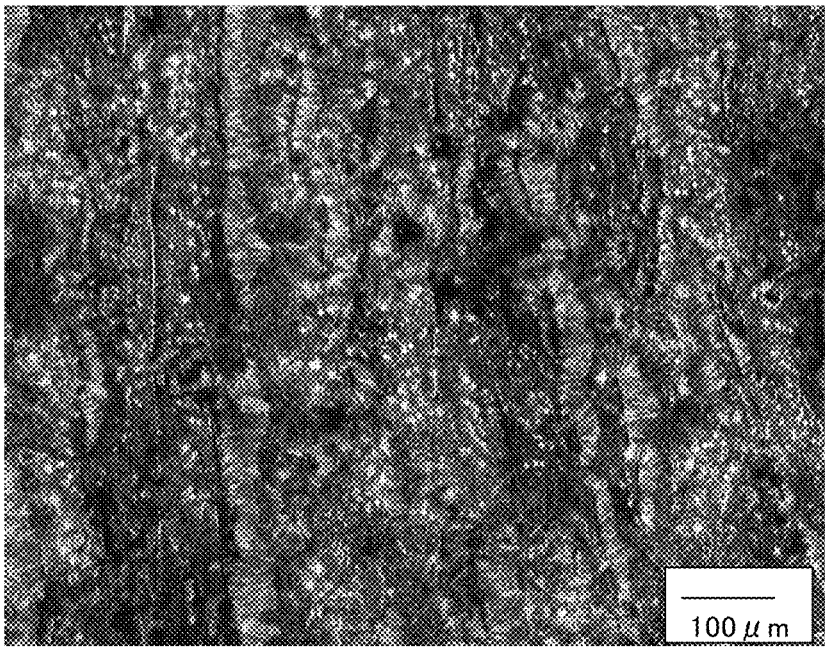
FIG. 3 is a copy of a micrograph of an alloy flake obtained in Comparative Example 1 taken on its roll-cooled face.
Figure 4:
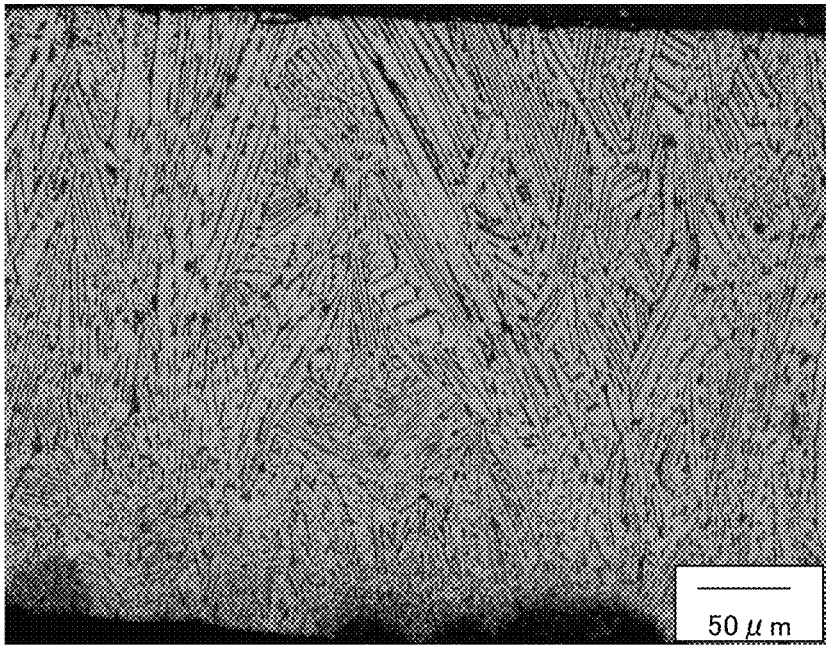
FIG. 4 is a copy of a micrograph of a sectional structure of the alloy flake obtained in Comparative Example 1.

Alloy flakes and a sintered magnet were prepared in the same way as in Example 1 except that a cooling roll was used which had been abraded on its surface with #60 sandpaper only in the direction of rotation of the roll, and had Ra and Rsk values shown in Table 1. The various measurements were made in the same way as in Example 1. The results are shown in Table 1. A copy of the micrograph of the roll-cooled face of an obtained alloy flake is shown in FIG. 3, and a copy of the micrograph of the sectional structure is shown in FIG. 4.

Comparative Example 2

Alloy flakes and a sintered magnet were prepared in the same way as in Comparative Example 1 except that the raw materials were selected so as to have a volatile element content of 0.90 mass %, and a cooling roll having Ra and Rsk values shown in Table 1 was used. The content of the volatile elements in the obtained alloy flakes was 0.12 mass %. The various measurements were made in the same way as in Example 1. The results are shown in Table 1.

Comparative Example 3

Alloy flakes and a sintered magnet were prepared in the same way as in Example 1 except that a cooling roll was used which had been abraded on its surface with #60 sandpaper in the direction at 45° with respect to the direction of rotation of the roll, and had Ra and Rsk values shown in Table 1. The various measurements were made in the same way as in Example 1. The results are shown in Table 1.

Comparative Example 4

Alloy flakes and a sintered magnet were prepared in the same way as in Example 1 except that a cooling roll was used which had been abraded on its surface with #60 sandpaper in the directions crossing with each other at 45° and −45° with respect to the direction of rotation of the roll, and had Ra and Rsk values shown in Table 1. The various measurements were made in the same way as in Example 1. The results are shown in Table 1.

TABLE 1

| | Ra (μm) | Rsk | Volatile elements in raw material (mass %) | Volatile elements in alloy flakes (mass %) | Number of nuclei | Content of chill crystals (%) | Distance between R-rich phases (μm) | Value obtained by dividing standard deviation of distance between R-rich phases by average distance between R-rich phases | Br (kG) | iHc (kOe) |
|---|---|---|---|---|---|---|---|---|---|---|
| Ex 1 | 3.01 | −0.44 | <0.05 | <0.01 | 15 | 0.00 | 4.51 | 0.15 | 12.65 | 26.49 |
| Ex 2 | 4.44 | −0.39 | <0.05 | <0.01 | 10 | 0.00 | 4.53 | 0.17 | 12.75 | 26.43 |
| Ex 3 | 6.51 | −0.12 | <0.05 | <0.01 | 13 | 0.00 | 4.51 | 0.15 | 12.64 | 26.52 |
| Ex 4 | 3.08 | −0.42 | 0.90 | 0.11 | 8 | 0.50 | 4.36 | 0.19 | 12.52 | 25.35 |
| Comp Ex 1 | 2.40 | −0.68 | <0.05 | <0.01 | 2 | 6.12 | 4.28 | 0.25 | 12.21 | 25.24 |
| Comp Ex 2 | 2.34 | −0.70 | 0.90 | 0.12 | 1 | 15.55 | 4.22 | 0.27 | 12.09 | 25.10 |
| Comp Ex 3 | 2.44 | −0.64 | <0.05 | <0.01 | 3 | 7.21 | 4.43 | 0.24 | 12.24 | 25.25 |
| Comp Ex 4 | 2.29 | −1.05 | <0.05 | <0.01 | 3 | 5.57 | 4.47 | 0.21 | 12.36 | 25.32 |

Example 5

Alloy flakes and a sintered magnet were prepared in the same way as in Example 1 except that the raw materials were blended taking the yield into consideration so as to eventually obtain alloy flakes of 29.6 mass % Nd, 2.4 mass % Dy, 1.0 mass % B, 0.15 mass % Al, 1.0 mass % Co, 0.2 mass % Cu, and the balance iron, and melted using an alumina crucible in a high frequency induction furnace in an argon gas atmosphere to obtain a raw material alloy melt. The various measurements were made in the same way as in Example 1. The results are shown in Table 2.

Example 6

Alloy flakes and a sintered magnet were prepared in the same way as in Example 5 except that a cooling roll was used which had been abraded in the direction of rotation of the roll with #60 sandpaper and at 90° with respect to the direction of rotation with #30 sandpaper, and had Ra and Rsk values shown in Table 2. The various measurements were made in the same way as in Example 1. The results are shown in Table 2.

Example 7

Alloy flakes and a sintered magnet were prepared in the same way as in Example 5 except that a cooling roll was used which had been shotblasted instead of the abrasion with sandpapers, and had Ra and Rsk values shown in Table 2. The various measurements were made in the same way as in Example 1. The results are shown in Table 2.

Example 8

Alloy flakes and a sintered magnet were prepared in the same way as in Example 5 except that the raw materials were selected so as to have a volatile element content of 0.90 mass %, and a cooling roll having Ra and Rsk values shown in Table 2 was used. The content of the volatile elements in the obtained alloy flakes was 0.11 mass %. The various measurements were made in the same way as in Example 1. The results are shown in Table 2.

Comparative Example 5

Alloy flakes and a sintered magnet were prepared in the same way as in Example 5 except that a cooling roll was used which had been abraded on its surface with #60 sandpaper only in the direction of rotation of the roll, and had Ra and Rsk values shown in Table 2. The various measurements were made in the same way as in Example 1. The results are shown in Table 2.

Comparative Example 6

Alloy flakes and a sintered magnet were prepared in the same way as in Comparative Example 5 except that the raw materials were selected so as to have a volatile element content of 0.90 mass %, and a cooling roll having Ra and Rsk values shown in Table 2 was used. The content of the volatile elements in the obtained alloy flakes was 0.12 mass %. The various measurements were made in the same way as in Example 1. The results are shown in Table 2.

Comparative Example 7

Alloy flakes and a sintered magnet were prepared in the same way as in Example 5 except that a cooling roll was used which had been abraded on its surface with #60 sandpaper in the direction at 45° with respect to the direction of rotation of the roll, and had Ra and Rsk values shown in Table 2. The various measurements were made in the same way as in Example 1. The results are shown in Table 2.

Comparative Example 8

Alloy flakes and a sintered magnet were prepared in the same way as in Example 5 except that a cooling roll was used which had been abraded on its surface with #60 sandpaper in the directions crossing with each other at 45° and −45° with respect to the direction of rotation of the roll, and had Ra and Rsk values shown in Table 2. The various measurements were made in the same way as in Example 1. The results are shown in Table 2.

TABLE 2

| | Ra (μm) | Rsk | Volatile elements in raw material (mass %) | Volatile elements in alloy flakes (mass %) | Number of nuclei | Content of chill crystals (%) | Distance between R-rich phases (μm) | Value obtained by dividing standard deviation of distance between R-rich phases by average distance between R-rich phases | Br (kG) | iHc (kOe) |
|---|---|---|---|---|---|---|---|---|---|---|
| Ex 5 | 3.00 | −0.42 | <0.05 | <0.01 | 16 | 0.00 | 4.59 | 0.15 | 12.82 | 21.40 |
| Ex 6 | 4.40 | −0.40 | <0.05 | <0.01 | 9 | 0.00 | 4.58 | 0.16 | 12.91 | 21.34 |
| Ex 7 | 6.48 | −0.15 | <0.05 | <0.01 | 10 | 0.02 | 4.62 | 0.15 | 12.77 | 21.43 |
| Ex 8 | 3.05 | −0.40 | 0.90 | 0.11 | 8 | 0.33 | 4.59 | 0.17 | 12.79 | 20.67 |
| Comp Ex 5 | 2.41 | −0.66 | <0.05 | <0.01 | 2 | 4.68 | 4.51 | 0.24 | 12.37 | 20.41 |
| Comp Ex 6 | 2.35 | −0.72 | 0.90 | 0.12 | 2 | 12.66 | 4.51 | 0.25 | 12.21 | 20.23 |
| Comp Ex 7 | 2.42 | −0.63 | <0.05 | <0.01 | 3 | 5.86 | 4.45 | 0.24 | 12.37 | 20.44 |
| Comp Ex 8 | 2.26 | −1.02 | <0.05 | <0.01 | 4 | 4.64 | 4.53 | 0.22 | 12.55 | 20.45 |

Example 9

Alloy flakes and a sintered magnet were prepared in the same way as in Example 1 except that the raw materials were blended taking the yield into consideration so as to eventually obtain alloy flakes of 18.2 mass % Nd, 10.8 mass % Dy, 0.92 mass % B, 0.15 mass % Al, 1.0 mass % Co, 0.2 mass % Cu, and the balance iron, and melted using an alumina crucible in a high frequency induction furnace in an argon gas atmosphere to obtain a raw material alloy melt, and that the raw materials were elected so as to have a volatile element content of 0.07 mass %. The various measurements were made in the same way as in Example 1. The results are shown in Table 3.

Example 10

Alloy flakes and a sintered magnet were prepared in the same way as in Example 9 except that a cooling roll was used which had been abraded in the direction of rotation of the roll with #60 sandpaper and at 90° with respect to the direction of rotation with #30 sandpaper, and had Ra and Rsk values shown in Table 3. The various measurements were made in the same way as in Example 1. The results are shown in Table 3.

Example 11

Alloy flakes and a sintered magnet were prepared in the same way as in Example 9 except that a cooling roll was used which had been shotblasted instead of the abrasion with sandpapers, and had Ra and Rsk values shown in Table 3. The various measurements were made in the same way as in Example 1. The results are shown in Table 3.

Example 12

Alloy flakes and a sintered magnet were prepared in the same way as in Example 9 except that the raw materials were selected so as to have a volatile element content of 0.95 mass %, and a cooling roll having Ra and Rsk values shown in Table 3 was used. The content of the volatile elements in the obtained alloy flakes was 0.13 mass %. The various measurements were made in the same way as in Example 1. The results are shown in Table 3.

Comparative Example 9

Alloy flakes and a sintered magnet were prepared in the same way as in Example 9 except that a cooling roll was used which had been abraded on its surface with #60 sandpaper only in the direction of rotation of the roll, and had Ra and Rsk values shown in Table 3. The various measurements were made in the same way as in Example 1. The results are shown in Table 3.

Comparative Example 10

Alloy flakes and a sintered magnet were prepared in the same way as in Comparative Example 9 except that the raw material were selected so as to have a volatile element content of 0.95 mass %, and a cooling roll having Ra and Rsk values shown in Table 3 was used. The content of the volatile elements in the obtained alloy flakes was 0.13 mass %. The various measurements were made in the same way as in Example 1. The results are shown in Table 3.

Comparative Example 11

Alloy flakes and a sintered magnet were prepared in the same way as in Example 9 except that a cooling roll was used which had been abraded on its surface with #60 sandpaper in the direction at 45° with respect to the direction of rotation of the roll, and had Ra and Rsk values shown in Table 3. The various measurements were made in the same way as in Example 1. The results are shown in Table 3.

Comparative Example 12

Alloy flakes and a sintered magnet were prepared in the same way as in Example 9 except that a cooling roll was used which had been abraded on its surface with #60 sandpaper in the directions crossing with each other at 45° and −45° with respect to the direction of rotation of the roll, and had Ra and Rsk values shown in Table 3. The various measurements were made in the same way as in Example 1. The results are shown in Table 3.

TABLE 3

| | Ra (μm) | Rsk | Volatile elements in raw material (mass %) | Volatile elements in alloy flakes (mass %) | Number of nuclei | Content of chill crystals (%) | Distance between R-rich phases (μm) | Value obtained by dividing standard deviation of distance between R-rich phases by average distance between R-rich phases | Br (kG) | iHc (kOe) |
|---|---|---|---|---|---|---|---|---|---|---|
| Ex 9 | 3.00 | −0.42 | 0.07 | <0.01 | 17 | 0.00 | 4.49 | 0.16 | 12.45 | 30.08 |
| Ex 10 | 4.45 | −0.38 | 0.07 | <0.01 | 11 | 0.00 | 4.44 | 0.15 | 12.58 | 30.05 |
| Ex 11 | 6.46 | −0.11 | 0.07 | <0.01 | 12 | 0.21 | 4.45 | 0.17 | 12.41 | 30.02 |
| Ex 12 | 3.11 | −0.42 | 0.95 | 0.13 | 9 | 0.42 | 4.47 | 0.18 | 12.37 | 28.81 |
| Comp Ex 9 | 2.38 | −0.69 | 0.07 | <0.01 | 1 | 8.06 | 4.31 | 0.29 | 12.01 | 28.65 |
| Comp Ex 10 | 2.36 | −0.70 | 0.95 | 0.13 | 0 | 19.25 | 4.40 | 0.28 | 11.90 | 28.45 |
| Comp Ex 11 | 2.45 | −0.65 | 0.07 | <0.01 | 2 | 9.33 | 4.36 | 0.28 | 12.06 | 28.66 |
| Comp Ex 12 | 2.28 | −0.99 | 0.07 | <0.01 | 3 | 7.42 | 4.35 | 0.26 | 12.22 | 28.77 |

What is claimed is:

1. Raw material alloy flakes for a rare earth sintered magnet having a roll-cooled surface, obtained by strip casting with a cooling roll, and satisfying requirements (1) to (3) below:

(1) said alloy flakes comprise 27.0 to 33.0 mass % of R consisting of one or more rare earth metal elements selected from the group consisting of lanthanoids and yttrium, 0.90 to 1.30 mass % of boron, and the balance M including iron;

(2) each of said alloy flakes, as observed in a micrograph at a magnification of 100× of its roll-cooled face, contains 5 or more crystals crossing a line of a length of 880 μm, and each of the crystals is a dendrite grown radially from a point of nucleation and has an aspect ratio of 0.5 to 1.0 and a crystal grain size of not smaller than 30 μm; and (3) each of said alloy flakes, as observed in a micrograph at a magnification of 200× of its section taken generally perpendicularly to its roll-cooled face, has an average distance between R-rich phases of not less than 1 μm and less than 10 μm, and a value obtained by dividing the standard deviation of the distance between the R-rich phases by the average distance between the R-rich phases is not more than 0.20, wherein said alloy flakes are produced by a method comprising steps of:

providing a raw material alloy melt consisting of 27.0 to 33.0 mass % of R consisting of one or more rare earth metal elements selected from the group consisting of lanthanoids and yttrium, 0.90 to 1.30 mass % of boron, and the balance M including iron; and cooling and solidifying said raw material alloy melt on a cooling roll having a surface roughness Ra of 2 to 15 μm and a surface roughness Rsk of not less than −0.5 and less than 0.

2. The raw material alloy flakes according to claim 1, wherein said balance M in requirement (1) comprises at least one element selected from the group consisting of cobalt, aluminum, chromium, titanium, vanadium, zirconium, hafnium, manganese, copper, tin, tungsten, niobium, gallium, silicon, and carbon.

3. The raw material alloy flakes according to claim 1, wherein the alloy flakes allow for the presence of one or more inevitable impurities selected from the group consisting of alkali metal elements, alkaline earth metal elements, and zinc, and the total content of the inevitable impurities is not more than 0.10 mass %.

4. A method for producing the raw material alloy flakes for a rare earth sintered magnet according to claim 1 comprising the steps of:

providing a raw material alloy melt consisting of 27.0 to 33.0 mass % of at least one R selected from the group consisting of rare earth metal elements including yttrium, 0.90 to 1.30 mass % of boron, and the balance M including iron; and cooling and solidifying said raw material alloy melt on a cooling roll having a surface roughness Ra of 2 to 15 μm and a surface roughness Rsk of not less than −0.5 and less than 0.

5. The method according to claim 4, wherein said balance M of the raw material alloy melt comprises at least one element selected from the group consisting of transition metal elements other than iron, silicon, and carbon.

6. The method according to claim 4, wherein said raw material alloy melt further comprises, other than said R, boron, and the balance M, at least one impurity selected from the group consisting of alkali metal elements, alkaline earth metal elements, and zinc, at a total content of not more than 0.15 mass %.

7. The raw material alloy flakes according to claim 2, wherein the alloy flakes contain one or more inevitable impurities selected from the group consisting of alkali metal elements, alkaline earth metal elements, and zinc, and a total content of the inevitable impurities is not more than 0.10 mass % based on the total mass of the alloy flakes.

8. The method according to claim 5, wherein said raw material alloy melt further comprises, other than said R, boron, and the balance M, at least one impurity selected from the group consisting of alkali metal elements, alkaline earth metal elements, and zinc, at a total content of not more than 0.15 mass %.

* * * * *